US012369696B2

(12) United States Patent
Devries

(10) Patent No.: US 12,369,696 B2
(45) Date of Patent: Jul. 29, 2025

(54) LUGGAGE SYSTEM WITH REMOVABLE CARRYING BAG AND COMPRESSION SYSTEM

(71) Applicant: Exemplis LLC, Cypress, CA (US)

(72) Inventor: Paul Devries, Huntington Beach, CA (US)

(73) Assignee: Exemplis LLC, Cypress, CA (US)

( * ) Notice: Subject to any disclaimer, the term of this patent is extended or adjusted under 35 U.S.C. 154(b) by 0 days.

(21) Appl. No.: 18/637,755

(22) Filed: Apr. 17, 2024

(65) Prior Publication Data

US 2024/0341426 A1 Oct. 17, 2024

Related U.S. Application Data

(63) Continuation of application No. PCT/US2024/021373, filed on Mar. 25, 2024.

(60) Provisional application No. 63/492,195, filed on Mar. 24, 2023.

(51) Int. Cl.

| | |
|---|---|
| ***A45C 9/00*** | (2006.01) |
| ***A45C 5/03*** | (2006.01) |
| ***A45C 13/02*** | (2006.01) |
| ***A45F 4/02*** | (2006.01) |

(52) U.S. Cl.

CPC ..... *A45C 9/00* (2013.01); *A45C 5/03* (2013.01); *A45C 13/02* (2013.01); *A45F 4/02* (2013.01)

(58) Field of Classification Search

CPC .. A45C 9/00; A45C 5/03; A45C 13/02; A45F 4/02

See application file for complete search history.

(56) References Cited

U.S. PATENT DOCUMENTS

| | | | | |
|---|---|---|---|---|
| 792,246 A * | 6/1905 | Andrews et al. | ..... | A45C 13/02 190/36 |
| 1,496,498 A * | 6/1924 | Tantlinger | ..... | A45C 13/02 190/36 |
| 3,861,504 A | 1/1975 | McGraw | | |
| 4,273,223 A | 6/1981 | Tomlinson | | |

(Continued)

FOREIGN PATENT DOCUMENTS

| | | |
|---|---|---|
| CA | 3061529 A1 | 5/2020 |
| CN | 110786608 A | 2/2020 |

(Continued)

OTHER PUBLICATIONS

"Cruise 3.0 Collection," Delsey Paris, retrieved from https://us.delsey.com/collections/cruise-30, retrieved on Jul. 11, 2024, pages.

(Continued)

*Primary Examiner* — Tri M Mai
(74) *Attorney, Agent, or Firm* — VIA LLP

(57) ABSTRACT

A luggage system (102) can include an outer luggage body (110) having a first luggage body portion (112), at least a first anchor (118) secured to the first luggage body portion, a carry bag (230), which can be in the form of a backpack or other wearable bag. The carry bag can include a main body portion with at least one interior compartment and a first shoulder strap (236) connected to the main body portion. A first compression strap (260) assembly can be configured to engage the main body portion and the first anchor and be configured to cinch the main body portion towards the first anchor.

9 Claims, 4 Drawing Sheets

(56) References Cited

U.S. PATENT DOCUMENTS

| | | | | |
|---|---|---|---|---|
| 4,951,818 | A * | 8/1990 | Johnson | A45C 13/36 190/127 |
| 5,096,030 | A | 3/1992 | Espinosa et al. | |
| 5,588,569 | A * | 12/1996 | Mitomi | A45C 5/14 190/110 |
| 6,000,509 | A | 12/1999 | Chisholm | |
| 6,135,253 | A | 10/2000 | Weissman et al. | |
| 6,435,324 | B1 * | 8/2002 | Hoberman | A45C 13/02 190/110 |
| D483,563 | S | 12/2003 | Dwight et al. | |
| 9,198,492 | B2 | 12/2015 | Chehebar | |
| 9,345,298 | B2 | 5/2016 | Bettua et al. | |
| 9,428,234 | B2 | 8/2016 | Bopanna et al. | |
| 9,609,938 | B1 | 4/2017 | Wilson | |
| 10,123,601 | B1 | 11/2018 | Tong | |
| 10,219,600 | B2 | 3/2019 | Korey et al. | |
| 11,013,305 | B2 | 5/2021 | Jackson et al. | |
| 11,083,277 | B2 | 8/2021 | Sniffen | |
| 11,253,048 | B2 | 2/2022 | Logan et al. | |
| 11,517,086 | B2 * | 12/2022 | Nichols | A45C 13/262 |
| 2002/0113102 | A1 | 8/2002 | Klamm | |
| 2002/0162718 | A1 | 11/2002 | Wu | |
| 2007/0125815 | A1 | 6/2007 | Tong | |
| 2009/0139814 | A1 | 6/2009 | Grossman et al. | |
| 2009/0194541 | A1 | 8/2009 | Mayo | |
| 2010/0294607 | A1 | 11/2010 | Morszeck | |
| 2012/0222931 | A1 | 9/2012 | Zuckerman | |
| 2012/0222932 | A1 | 9/2012 | Wang | |
| 2013/0175130 | A1 | 7/2013 | Liang | |
| 2015/0027833 | A1 | 1/2015 | Taylor et al. | |
| 2017/0127783 | A1 | 5/2017 | Korey et al. | |
| 2017/0347765 | A1 | 12/2017 | Jackson et al. | |
| 2019/0269217 | A1 | 9/2019 | Langford | |
| 2020/0037719 | A1 | 2/2020 | Jaworski et al. | |
| 2020/0229568 | A1 | 7/2020 | Nichols et al. | |
| 2020/0323323 | A1 | 10/2020 | Wu | |
| 2020/0352310 | A1 | 11/2020 | Logan et al. | |
| 2021/0204663 | A1 | 7/2021 | Nichols et al. | |
| 2021/0321732 | A1 | 10/2021 | Majhess et al. | |
| 2021/0393010 | A1 | 12/2021 | Moon | |
| 2022/0104596 | A1 | 4/2022 | Tedesco et al. | |
| 2022/0287483 | A1 * | 9/2022 | Fischenich | A47C 7/386 |

FOREIGN PATENT DOCUMENTS

| | | | | |
|---|---|---|---|---|
| CN | 113768261 | A | 12/2021 | |
| EP | 2341793 | A1 | 7/2011 | |
| EP | 3653077 | A1 | 5/2020 | |
| TW | M575289 | U | 3/2019 | |
| TW | M611837 | U | 5/2021 | |
| WO | 2010/033133 | A1 | 3/2010 | |
| WO | 2020/028164 | A1 | 2/2020 | |
| WO | 2020/142777 | A2 | 7/2020 | |
| WO | 2020/206312 | A2 | 10/2020 | |
| WO | WO-2021195625 | A1 * | 9/2021 | A45C 13/30 |

OTHER PUBLICATIONS

"Elevation™ Plus Hardside Global Carry-On Spinner", Samsonite, retrieved from https://shop.samsonite.com/luggage/carry-on-luggage/elevation-plus-22x14x9-spinner/142909XXXX.html?dwvar_142909XXXX_color=1429091244&cgidmaster=new-arrivals-luggage, Jul. 11, 2024, 4 pages.

"Luggage that travels better and stores smaller," Max Mirani, retrieved from https://www.josephdesign.com/projects/max-mirani, retrieved on Apr. 30, 2024, 7 pages.

International Search Report and Written Opinion received for PCT Patent Application No. PCT/US2024/021373, mailed on Jun. 14, 2024, 12 pages.

Samsonite, Elevation (Trademark), Plus Hardside Global Carry-On Spinner, New Samsonite Elevation Plus 22x14x9 Spinner, available online at: <https://shop.samsonite.com/luggage/carry-on-luggage/elevation%E2%84%A2-plus-hardside-global-carry-on-spinner/142909XXXX.html?dwvar_142909XXXX_color=1429091244&cgidmaster=new-arrivals->, retrieved on Aug. 1, 2024, 4 pages.

U.S. Appl. No. 62/788,886, filed Jan. 6, 2019, entitled "Luggage System" by Nichols et al.

* cited by examiner

LUGGAGE SYSTEM WITH REMOVABLE CARRYING BAG AND COMPRESSION SYSTEM

CROSS-REFERENCE TO APPLICATION

This application is a continuation of PCT Application No. PCT/US24/21373 Filed Mar. 25, 2024, which claims priority to U.S. Provisional Application No. 63/492,195, filed Mar. 24, 2023, both of which are incorporated herein by reference in its entirety.

COPYRIGHT NOTICE

A portion of the disclosure of this patent document contains material which is subject to copyright protection. The copyright owner recognizes the public's right to the reproduction of the patent document or the patent disclosure as it appears in the Patent and Trademark Office patent file or records, but otherwise reserves all copyright rights whatsoever.

BACKGROUND OF THE INVENTIONS

Field of the Inventions

The present inventions relate to luggage systems with components designed to provide for compression.

SUMMARY OF THE INVENTIONS

An aspect of at least one of the inventions disclosed herein includes the realization that luggage can be provided with a removable bag that serves the dual purposes of providing a smaller carrying bag, such as a tote, messenger bag, backpack or the like as well as a compression assembly for luggage. For example, the luggage can be in the form of a carry-on or a check-in sized piece of luggage. Some known designs for these types include removable compression members.

By configuring a carrying bag to be usable as a compression device within a piece of luggage, a user can benefit from the dual uses of the carrying bag for daily use in carrying personal items and as a compression member for efficiently packing the luggage. This allows a user the option of releasing the carry bag from its compression configuration, then using the carry bag as they would normally use a carry bag such as a tote, messenger bag, backpack, or the like.

Another aspect of at least one of the inventions disclosed herein includes the realization that certain additional, optional efficiencies can be realized by using existing strap connection points on a carry bag, such as a backpack or shoulder bag, for the additional function of compression. For example, carry bags, including backpacks and shoulder bags, can include structural connections between upper and lower strap connection points, which are designed to withstand the loads imparted to the body of the bag, during use. Backpack shoulder strap connection points are subjected to more than the full weight of the backpack and its contents, during use, such as those loads generated by g-forces or attempted theft. Thus, these connection points are attached to the carry bag with such maximum structural loads in mind. Some such carry bags include a structural connection between the upper and lower connection points for withstanding such loads. For example, in some backpacks, the structural connection between upper and lower shoulder strap connection points is formed with fabric that may or may not be exposed on the outer surface of the bag. For example, such a structural interconnection may be formed with a fabric having a minimum Denier rating, webbing, or other material that is the same or different than the material on the exterior of the carry bag.

Another aspect of at least one of the inventions disclosed herein includes the realization that using a carry bag as a compression plate subjects the carry bag to higher and/or different loads. If connection points for compression were formed on a weaker area of the bag, other portions of the bag, such as zippers or other accessory compartments, might be subjected to excessive loads that could cause damage or requiring additional strengthening to be added to the bag. Thus, in some embodiments, a carry bag can include connection points which are also used for both shoulder strap connections and compression purposes. However, in other embodiments, a carry bag could be provided with connection points in other locations, for example, on the outwardly facing surface of the carry bag. In such embodiments, the connection points can be arranged to avoid subjecting weaker portions of the carry bag to excessive loads. In other optional embodiments, such connection points could be connected with reinforcing material, such as webbing, disposed on an exterior or recessed from the exterior of the carry bag.

Another aspect of at least one of the inventions disclosed herein includes the realization that by locating anchors at effective height within associated luggage which are less than the full height of a carry bag, the anchors can be used to compress the carry bag within the luggage, even if there are no compressible objects in the interior volume of the carry bag and even when the carry bag is resting on an inner surface of the luggage. In this scenario, the carry bag could include compressible items within the main interior compartment of the carry bag, and the anchors can be used for compressing the carry bag and such items therein.

In some aspects, the techniques described herein relate to a luggage system including: an outer luggage body including: a first luggage body portion including a first upper periphery, a first sidewall extending around the first upper periphery and a first inner wall recessed inwardly from the first upper periphery and connected to the first sidewall, wherein a first interior volume portion is defined between the first inner wall, the first upper periphery, and the first sidewall; a second luggage body portion defining a second interior volume portion and including a second upper periphery, the second luggage body portion being connected to the first luggage body portion so as to be moveable between opened and closed positions; a closure mechanism configured to releasably secure the first and second luggage body portions in the closed position; at least first and second upper anchors and first and second lower anchors secured to the first luggage body portion at locations spaced from the second upper periphery and recessed within the second interior volume portion; a carry bag in a form of a backpack, including: a main body portion including an upper portion, a lower portion, and at least one interior compartment; first and second upper shoulder strap connectors secured to the upper portion of the main body portion; first and second lower shoulder strap connectors secured to the lower portion of the main body portion; a first shoulder strap including first upper and first lower connectors configured to releasably engage the first upper shoulder strap connector and the first lower shoulder strap connector, respectively; a second shoulder strap including second upper and second lower connectors configured to releasably engage the second upper shoulder strap connector and the second lower shoulder strap connector, respectively; and a first pair of upper compression straps, each of the first pair of upper compression straps including a first free end and a first compression strap connector configured to releasably engage one of the first and second upper connectors, each of the pair of first compression straps being engaged with one of the first and second upper anchors such that when each first compression strap connector is engaged with each first upper connector, each first free end of each first compression strap can be pulled so as to cinch the upper portion of the main body portion towards the first and second upper anchors for compressing objects positioned between the main body portion and an inner surface of the first luggage body portion; a second pair of lower compression straps, each of the second pair of lower compression straps including a second free end and a second compression strap connector configured to releasably engage one of the first and second lower connectors, each of the second pair of lower compression straps being engaged with one of the first and second lower anchors such that when each second compression strap connector is engaged with each lower connector, each second free end of each second lower compression strap can be pulled so as to cinch the lower portion of the main body portion towards the first and second lower anchors for compressing objects positioned between the main body portion and the inner surface of the first luggage body portion; wherein the carry bag functions as a wearable backpack when the first and second shoulder straps are connected to the main body portion and functions as a compression plate when the main body portion is cinched towards the inner surface of the first luggage body portion with the first pair of upper compression straps and the second pair of lower compression straps.

In some aspects, the techniques described herein relate to a luggage system, wherein the main body portion of the carry bag includes a user-facing side and wherein the carry bag and the first and second shoulder straps are configured such that the user-facing side rests against a user of the carry bag, in use, and wherein the first and second lower shoulder strap connectors are fixed to the user-facing side of the main body portion.

In some aspects, the techniques described herein relate to a luggage system, wherein the main body portion of the carry bag includes an outwardly-facing side and wherein the carry bag and the first and second shoulder straps are configured such that the outwardly-facing side faces away from a user of the carry bag, in use, and wherein the first and second lower shoulder strap connectors are fixed to the outwardly-facing side of the main body portion.

In some aspects, the techniques described herein relate to a luggage system, wherein the first pair of upper compression straps and the second pair of lower compression straps are permanently affixed to the carry bag or the first luggage body portion.

In some aspects, the techniques described herein relate to a luggage system including: an outer luggage body including: a first luggage body portion including a first upper periphery, a first sidewall extending around the first upper periphery and a first inner wall recessed inwardly from the first upper periphery and connected to the first sidewall, wherein a first interior volume portion is defined between the first inner wall, the first upper periphery, and the first sidewall; a second luggage body portion defining a second interior volume portion and including a second upper periphery, the second luggage body portion being connected to the first luggage body portion so as to be moveable between opened and closed positions; a closure mechanism configured to releasably secure the first and second luggage body portions in the closed position; at least first and second upper anchors and first and second lower anchors secured to the first luggage body portion at locations spaced from the second upper periphery and recessed within the second interior volume portion; a carry bag in a form of a backpack, including: a main body portion including an upper portion, a lower portion, and at least one interior compartment; first and second upper shoulder strap connectors secured to the upper portion of the main body portion; first and second lower shoulder strap connectors secured to the lower portion of the main body portion; a first shoulder strap including first upper and first lower connectors configured to releasably engage the first upper shoulder strap connector and the first lower shoulder strap connector, respectively; a second shoulder strap including second upper and second lower connectors configured to releasably engage the second upper shoulder strap connector and the second lower shoulder strap connector, respectively; and a first upper compression strap including a first free end and a first compression strap connector configured to releasably engage the first upper connector, the first upper compression strap being engaged with the first upper anchor such that when the first compression strap connector is engaged with the first upper connector, the first free end of the first upper compression strap can be pulled so as to cinch the upper portion of the main body portion towards the first upper anchor; a second lower compression strap including a second free end and a second compression strap connector configured to releasably engage the first lower connectors, the second lower compression strap being engaged with the first lower anchor such that when the second compression strap connector is engaged with the first lower connector, the second free end can be pulled so as to cinch the lower portion of the main body portion towards the first lower anchors.

In some aspects, the techniques described herein relate to a luggage system, wherein the first upper and lower compression straps are configured to compress objects positioned between the main body portion and an inner surface of the first luggage body portion.

In some aspects, the techniques described herein relate to a luggage system, additionally including a second upper compression strap configured to engage the second upper second upper connector and the second upper anchors and a second lower compression strap.

In some aspects, the techniques described herein relate to a luggage system, wherein the carry bag functions as a backpack when the first and second shoulder straps are connected to the main body portion and as a compression plate when the main body portion is engaged with the first luggage body portion with the first upper compression strap and the second lower compression strap.

In some aspects, the techniques described herein relate to a luggage system, wherein the main body portion of the carry bag includes a user-facing side and wherein the carry bag and the first and second shoulder straps are configured such that the user-facing side rests against a user of the carry bag, in use, and wherein the first and second lower shoulder strap connectors are fixed to the user-facing side of the main body portion.

In some aspects, the techniques described herein relate to a luggage system, wherein the main body portion of the carry bag includes an outwardly-facing side and wherein the carry bag and the first and second shoulder straps are configured such that the outwardly-facing side faces away from a user of the carry bag, in use, and wherein the first and second lower shoulder strap connectors are fixed to the outwardly-facing side of the main body portion.

In some aspects, the techniques described herein relate to a luggage system, wherein the first pair of upper compression straps and the second pair of lower compression straps are permanently affixed to the carry bag or the first luggage body portion.

In some aspects, the techniques described herein relate to a luggage system including: an outer luggage body including: a first luggage body portion including a first upper periphery, a first sidewall extending around the first upper periphery and a first inner wall recessed inwardly from the first upper periphery and connected to the first sidewall, wherein a first interior volume portion is defined between the first inner wall, the first upper periphery, and the first sidewall; at least a first anchor secured to the first luggage body portion at a location spaced from the first upper periphery and recessed within the first interior volume portion; a carry bag including: a main body portion including an upper portion, a lower portion, and at least one interior compartment; a first shoulder strap connected to the main body portion; and a first compression strap assembly configured to engage the main body portion and the first anchor and configured to cinch the main body portion towards the first anchor.

In some aspects, the techniques described herein relate to a luggage system, wherein the first anchor is secured to first inner wall.

In some aspects, the techniques described herein relate to a luggage system, wherein the carry bag is in a form of a backpack.

In some aspects, the techniques described herein relate to a luggage system, wherein the carry bag includes first and second upper shoulder strap connectors secured to the upper portion of the main body portion and first and second lower shoulder strap connectors secured to the lower portion of the main body portion.

In some aspects, the techniques described herein relate to a luggage system, wherein the first compression strap assembly includes a y-strap having a first end configured to engage a single compression strap connector on the upper portion of the main body portion and a second end configured to engage two compression strap connectors at the lower portion of the main body portion.

In some aspects, the techniques described herein relate to a luggage system, wherein the first compression strap assembly includes a first upper compression strap including a first free end and a first compression strap connector configured to releasably engage a first upper connector on the main body portion, the first upper compression strap being engaged with the anchor such that when the first compression strap connector is engaged with the first upper connector, the first free end of the first upper compression strap can be pulled so as to cinch the upper portion of the main body portion towards the first anchor and a second lower compression strap including a second free end and a second compression strap connector configured to releasably engage the a second lower connector on the main body, the second lower compression strap being engaged with a first lower anchor in the first luggage body portion such that when the second compression strap connector is engaged with the second lower connector, the second free end can be pulled so as to cinch the lower portion of the main body portion towards the first lower anchor.

In some aspects, the techniques described herein relate to a luggage system, wherein the first compression strap assembly includes the first shoulder strap.

In some aspects, the techniques described herein relate to a luggage system, wherein the first compression strap assembly is configured to compress objects positioned between the main body portion and an inner surface of the first luggage body portion.

In some aspects, the techniques described herein relate to a luggage system, wherein the first compression strap assembly engages the main body portion in at least three locations.

In some aspects, the techniques described herein relate to a luggage system, wherein the carry bag is configured to be worn by a user over at least one shoulder of the user, in use and is configured to function as a compression plate when the main body portion is engaged with the first luggage body portion with the first compression strap assembly.

In some aspects, the techniques described herein relate to a luggage system, wherein the main body portion of the carry bag includes a user-facing side and wherein the carry bag and the first shoulder strap are configured such that the user-facing side rests against a user of the carry bag, in use, and wherein the carry bag further includes first and second compression strap connectors fixed to the user-facing side of the main body portion.

In some aspects, the techniques described herein relate to a luggage system, wherein the main body portion of the carry bag includes an outwardly-facing side and wherein the carry bag and the first shoulder strap are configured such that the outwardly-facing side faces away from a user of the carry bag, in use, and wherein the carry bag further includes first and second compression strap connectors fixed to the outwardly-facing side of the main body portion.

In some aspects, the techniques described herein relate to a luggage system, wherein the first compression strap assembly is permanently affixed to the carry bag or the first luggage body portion.

In some aspects, the techniques described herein relate to a luggage system including: an outer luggage body including: a first luggage body portion including an inner bottom wall; a carry bag including: a main body portion including at least one interior compartment; and a first compression strap assembly configured to engage the main body portion and configured to cinch the main body portion towards the inner bottom wall.

BRIEF DESCRIPTION OF THE DRAWINGS

These and other features of the inventions disclosed herein are described below with reference to the drawings of several embodiments of the present luggage systems which are intended to illustrate, but not to limit, the inventions. The drawings contain the following figures.

DETAILED DESCRIPTION OF THE PREFERRED EMBODIMENTS

Figure 1:
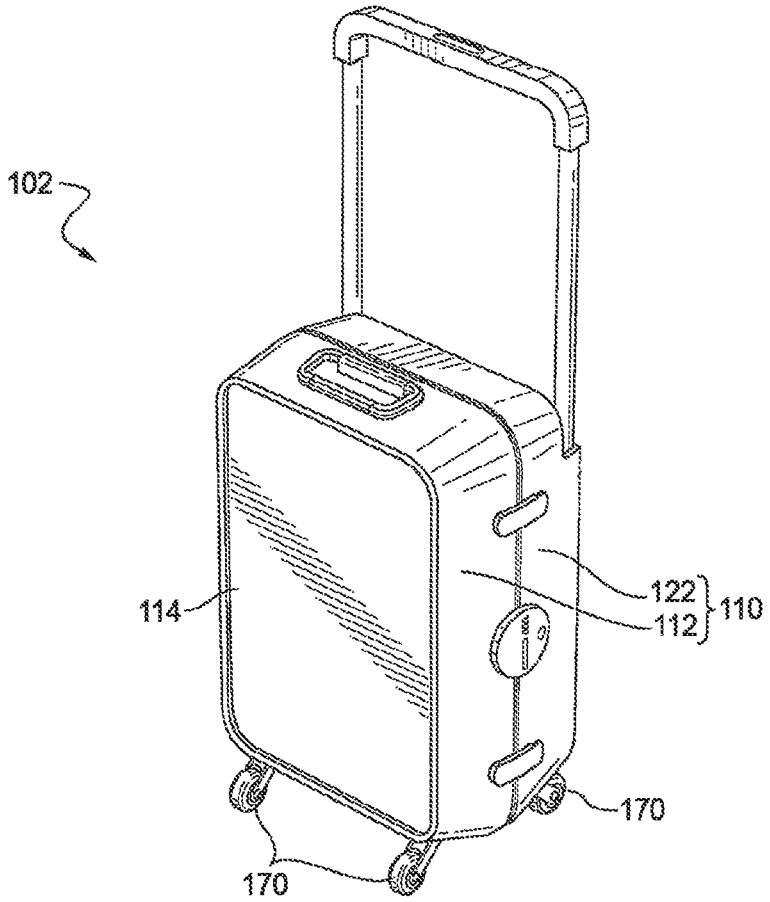
FIG. 1 is a perspective schematic view of a luggage system, according to an embodiment, with a hard shell body of the luggage system is closed.

An improved luggage system 102 is illustrated in the context of a removable backpack used as a compression member within a rolling luggage unit because it has particular context in this environment. However, the inventions disclosed herein can be used in other contexts as well, for example, with other types or forms of luggage, other types of carry bags, or other removable bags or components used as compression members within the luggage.

The following detailed description is merely illustrative in nature and is not intended to limit the embodiments of the subject matter or the application in uses of such embodiments. As used herein, the word "exemplary" means "serving as an example, instance or illustration." Any implementation described herein as exemplary is not necessarily to be construed as preferred or advantageous over other implementations. Furthermore, there is no intention to be bound by any expressed or implied theory presented in the preceding technical field, background, brief summary, or the following detailed description.

Certain terminology may be used in the following description for the purpose of reference only, and thus is not intended to be limiting. For example, terms such as "upper", "lower", "above", and "below" refer to directions in the drawings to which reference is made, and if indicated, can also refer to such directions during use or manufacture of the described embodiment. Terms such as "front", "back", "rear", and "side" describe the orientation and/or location of portions of the component within a consistent but arbitrary frame of reference which is made clear by reference to the text and the associated drawings describing a component. Such terminology may include the words specifically mentioned above, derivatives thereof, and words of similar import. Similarly, the terms "first", "second", and other such numerical terms referring to structures or methods do not indicate or require a limit on the number of permissible structures, or a required sequence or order unless expressly indicated or clearly implied by the context of the description.

Figure 2:
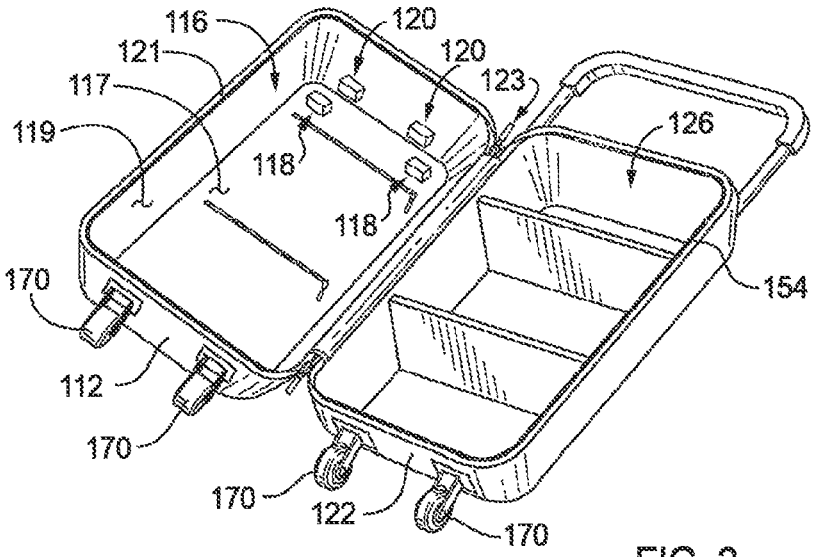
FIG. 2 is a perspective schematic view of the hard shell body of the luggage system of FIG. 1, with the hard shell body in an opened state.
Figure 3:
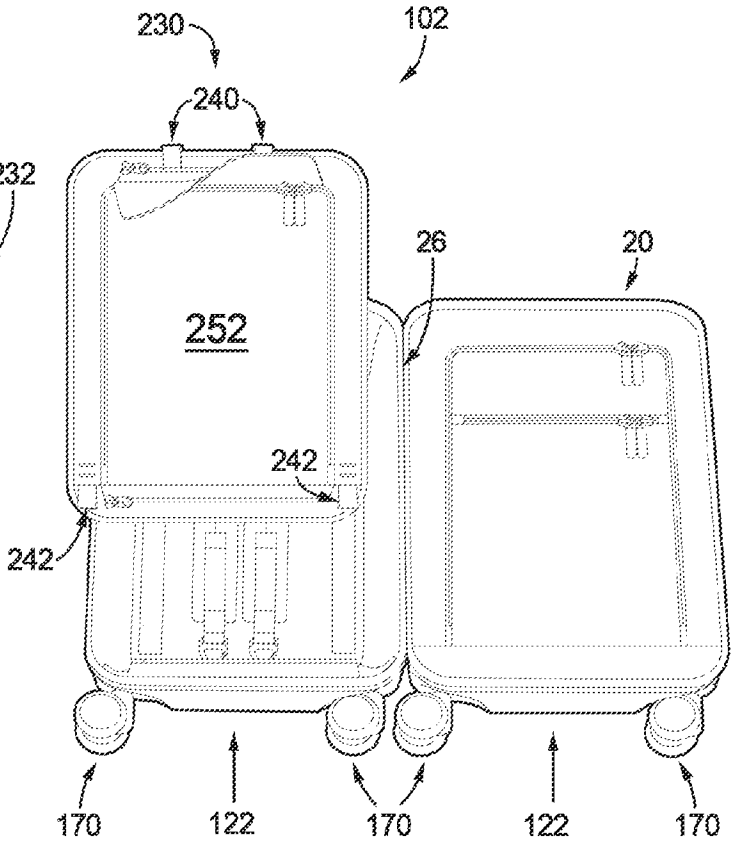
FIG. 3 is a plan and partial exploded schematic view of the luggage system including the hard shell body and a removable carry bag configured to function as a compression member in the hard shell body.
Figure 4:
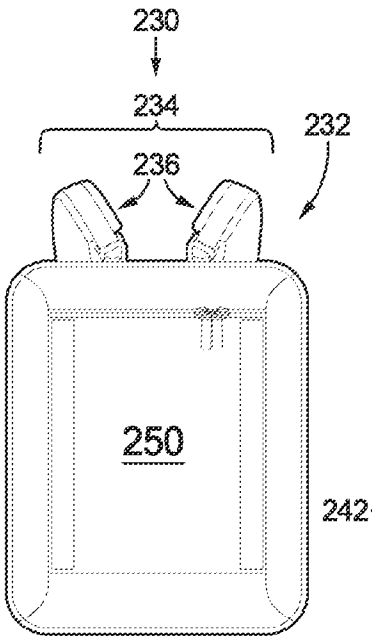
FIG. 4 is an elevational view of the backpack of FIG. 2 as viewed from behind during use.
Figure 5:
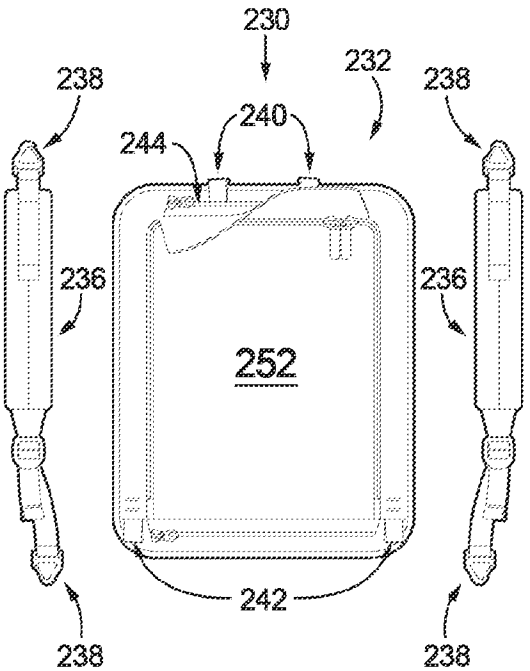
FIG. 5 is an elevational view of the inner side of the backpack (i.e., the side of the backpack that faces the user's back during use) with backpack straps illustrated in an exploded view.

FIGS. 1-2 will initially be used to describe a portion of a luggage system 102, according to an embodiment of the present technology. The luggage system 102 can include an outer luggage body 110 and removable carry bag 230 (FIGS. 3-5).

FIG. 1 is a perspective view of the luggage system 102, showing an outer luggage body 110 in a closed state in which the removable carry bag 230 can be contained and optionally be used as a compression plate, described in greater detail below with reference to FIGS. 3-5. FIG. 2 is a perspective view of the luggage system 102 while the outer luggage body 110 of the luggage system 102 is opened.

The outer luggage body 110 can be in the form of any type of known luggage, including, for example, but without limitation, a clamshell-type rolling luggage commonly used as carry-on bags, or checked bags for airline travel, or any other type of luggage. In the illustrated embodiment, the outer luggage body 110 is in the form of carry-on rolling luggage which includes first and second halves connected together by a hinge and can include clasps, latches and/or a zipper extending around the remainder of the periphery of each half in a typical, known manner.

The outer luggage body 110 can optionally be formed with generally non-resilient material (e.g., polycarbonate) but with a thickness that allows the panels of the outer luggage body 110 to conform to the contents therein. This type of outer structural configuration can provide high strength, puncture resistance, light weight and conformability and such configurations are well known in the art. Other materials and configurations can also be used.

The outer luggage body 110 can include a first body portion 112 and second hard shell body portion 122. The first and second body portions 112, 122 can be pivotally connected to one another to enable the outer luggage body 110 to be selectively opened and closed. The first body portion 112 can have a first hard shell exterior and can define a first storage compartment portion 116. The second hard shell body portion 122 can have a second hard shell exterior 124 and can define a second storage compartment portion 126.

In accordance with some embodiments, the interior storage compartment of the outer luggage body 110 includes both the first and second storage compartment portions 116, 126, can be considered as serving as first and second interior volume portions, respectively. The first storage compartment 116 can include a bottom wall 114 with an inner surface 117. A side wall can extend around a periphery of the bottom wall and can include an inner sidewall surface 119. The sidewall can also include an upper peripheral edge 121. The interior volume defined by the first storage compartment 116 can be considered as being defined between the inner surface 117, the inner sidewall surface 119, and the upper peripheral edge 121. One or more closure mechanisms can also be included for securing the first and second storage compartment portions 116, 126 to each other. For example, a zipper 123 can be included for securing the upper peripheral edge 121 of the first body portion 112 to an upper periphery of the second hard shell body portion 122. Other closure mechanisms can also be used.

As illustrated in FIG. 3, the luggage system 102 includes the outer luggage body 110 and a removable carry bag 230. The removable carry bag 230 and the outer luggage body 110 can optionally be configured such that the removable carry bag 230 can be used as a compression member.

Optionally, in some embodiments, the outer luggage body 110 can include anchor points configured to support compression, connected to an interior therein. For example, in some embodiments, the outer luggage body 110 can include anchors 118 and/or 120, which can serve as anchor points, and which can be mounted to interior surfaces of the internal volumes 116 and/or 126. For example, anchor points can be connected to the outer luggage body 110 so as to be accessible on the interior surface of the internal volumes 116, in a bottom wall location illustrated as anchors 118 and/or a sidewall location illustrated as anchors 120.

Although parts of the following description only mentions anchors 118, anchors 120 can also be used in place of the anchors 118 in the following descriptions. The outer luggage body 110 is also illustrated as including four sets of wheels 170. However, other arrangements of wheels can also be used.

Structurally, the anchors 118, 120 can be configured to cooperate with straps used for compression. The anchors 118, 120 can have any configuration, for example, loops, male or female receptacles, or other hardware. For example, the anchors 118, 120 can be configured to engage with tensioning straps attached to another structure for applying tension and drawing the other structure towards a bottom of the internal volume 116. This can optionally provide the functionality of a compression plate. For example, in some embodiments, the carry bag 230 can serve as a compression plate.

With reference to FIGS. 4 and 5, the carry bag 230 can be in a configuration of any bag configured for carrying by a user. In the illustrated embodiment, the carry bag 230 is in the form of a backpack. However, the carry bag 230 can be in the form of other types of carry bags, including, for example, but without limitation, purses, messenger, tote, duffel, or other types of bags.

In the illustrated embodiment, the carry bag 230, being in the configuration of a backpack, includes a main container portion 232 (which can also be considered to serve as a main body portion) and a carrying strap arrangement 234. Being in the configuration of a backpack, the carrying strap arrangement 234 includes a pair of backpack straps 236. In the illustrated embodiment, optionally, the backpack straps 236 can be removably attachable to the main container portion 232. For example, the backpack straps 236 can include connectors, for example, releasable clips 238, releasably connectable to connection points 240, 242 on the upper and lower ends of the main container portion 232. As such, the backpack straps 236 together can be considered as including first and second upper shoulder strap connectors and first and second lower shoulder strap connectors.

The connection points 240, 242 can have any known configuration, including, for example, but without limitation, fabric loops. In the illustrated configuration, there are two upper connection points 240 and two lower connection points 242. Thus, the carry bag 230 can be considered as including first and second upper connection points 240 and first and second lower connection points 242. Further, as shown in FIGS. 3 and 5, the upper connection points 240 can be retractable into and deployable from a zippered pocket 244.

In the illustrated embodiment, the bag 230 is worn with the straps 236 extending over the shoulders of the user. FIG. 4 illustrates the outwardly-facing side 250 of the bag 230 and FIG. 5 illustrates the inwardly-facing side 252 of the bag 230 which would face towards a user's back, in use. Thus, the inwardly-facing side 252 can also be considered as a user-facing side or a user-contacting side of the carry bag 230.

An aspect of at least one of the inventions disclosed herein includes the realization that certain additional, optional efficiencies can be realized by using existing strap connection points on a carry bag 230, such as a backpack or shoulder bag, for the additional function of compression. For example, carry bags, including backpacks and shoulder bags, can include structural connections between upper and lower strap connection points, which are designed to withstand the loads imparted to the body of the bag, during use. For example, backpack shoulder strap connection points are subjected to more than the full weight of the backpack and its contents, during use. Thus, these connection points are attached to the carry bag with the maximum structural loads in mind. Some such carry bags include a structural connection between the upper and lower connection points for withstanding such loads. For example, in some backpacks, the structural connection between upper and lower shoulder strap connection points is formed with fabric that may or may not be exposed on the outer surface of the bag. For example, such as structural interconnection may be formed with a fabric having a minimum Denier rating, webbing, or other material that is the same or different than the material on the exterior of the carry bag.

An aspect of at least one of the inventions disclosed herein includes the realization that using a carry bag as a compression plate subjects the carry bag to higher and or different loads. If connection points for compression were formed on a weaker area of the bag, other portions of the bag, such as zippers or other accessory compartments, might be subjected to excessive loads and thus requiring additional webbing to be added to the bag. Thus, in some embodiments, the carry bag 230 includes connection points 240, 242 which are also used for both shoulder strap connections and compression purposes. However, in other embodiments, the carry bag 230 could be provided with connection points in other locations, for example, on the outwardly facing surface 250 of the carry bag 230. In such embodiments, the connection points can be arranged to avoid subjecting weaker portions of the carry bag 230 to excessive loads. In other optional embodiments, such connection points could be connected with reinforcing material, such as webbing, disposed on an exterior or recessed from the exterior of the carry bag 230.

With continued reference to FIG. 3, in the illustrated embodiment, the form factor of the bag 230 can be close to the same size as and/or smaller than the periphery of one of the first and second body portions 112, 122 of the outer luggage body 110. In the illustrated embodiment, the bag 230 has an outer periphery that is approximately the same size as the inner periphery of the half 122 of the outer luggage body 110.

In some embodiments, the bag 230 can be placed over the opening of the half 122, with the inner surface 252 facing upwardly, as viewed in FIG. 5. In this configuration, optionally, the attachment points 40 and 42 can be secured to the half 122 and/or compressed against contents stored within the half 122 with additional tensioning straps secured to the inner side of the half 22, described in greater detail below with reference to FIGS. 6-8. Optionally the backpack straps 236 can be attached to points 240 and 242 (or alternate points) and be used as tensioning straps. As such, the bag 230 can be used as a compression member to retain and/or compress items which are packed within the half 122 and beneath the bag 230.

In some embodiments, the bag 230 can have a slim configuration with a small internal volume. In other embodiments, the bag 230 can have a larger interior volumetric size such as the typical interior volumetric capacity of known, commercially available backpacks. In embodiments where the bag 230 has a larger volumetric capacity, it can include collapsible side panels (not shown) allowing the bag 30 to collapse into a thinner configuration so as to be used as a compression member in a more efficient manner.

Optionally, as illustrated in FIG. 3, the backpack straps 236 can be removed from the carry bag 230 and placed under the bag 230 for storage within the outer luggage body 110.

Figure 6:
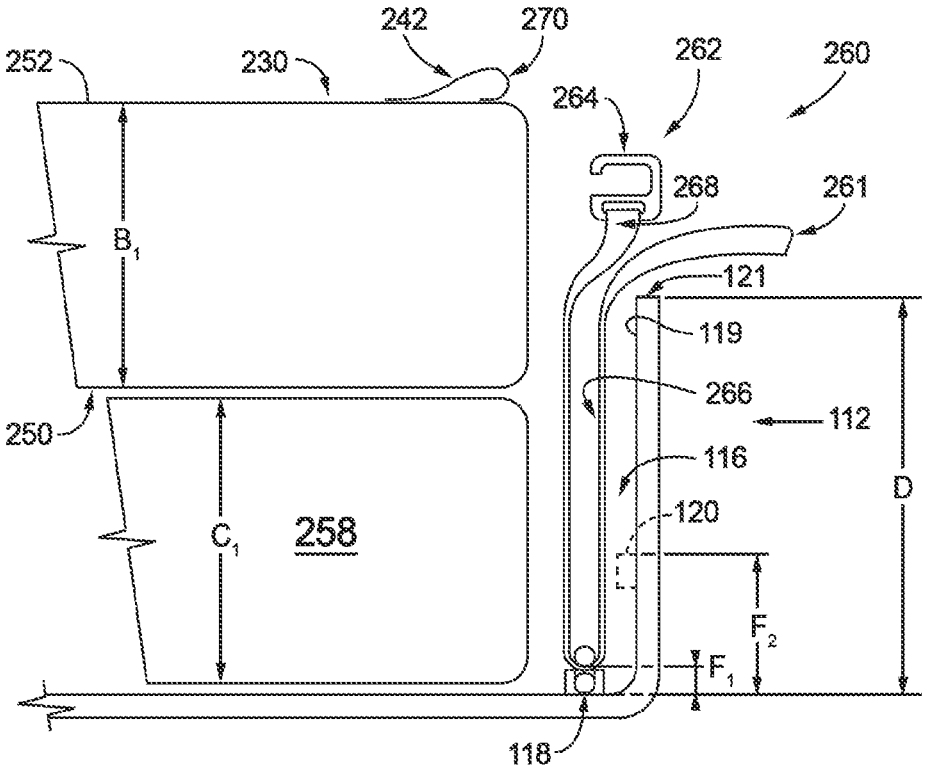
FIG. 6 is a schematic and partial sectional view of the backpack positioned on top of a schematic representation of compressible items for packing in luggage and within an internal volume of the hard shell body with an optional tensioning strap.
Figure 7:
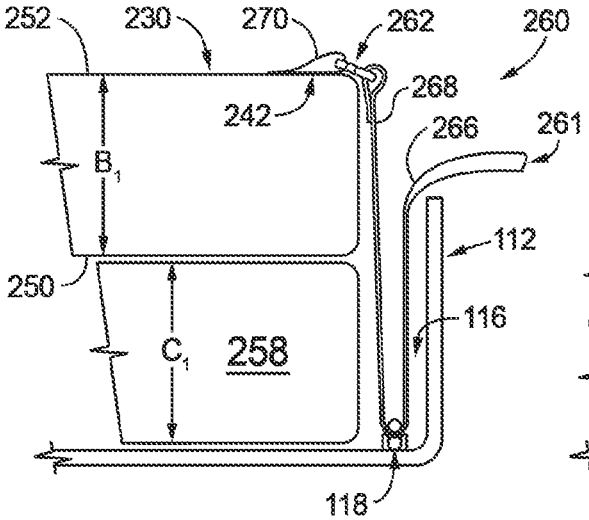
FIG. 7 is a further schematic and partial sectional view of the arrangement shown in FIG. 6 with an end of the tensioning strap connected to an anchor point on the backpack.
Figure 8:
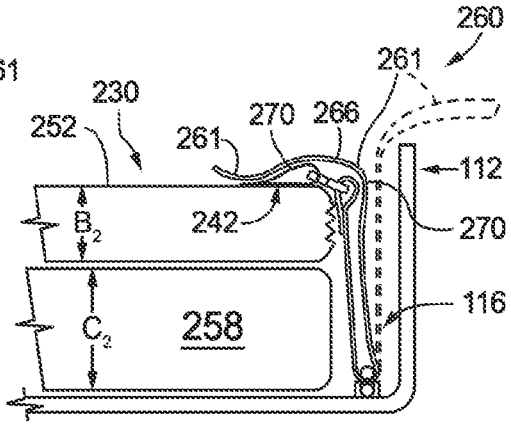
FIG. 8 is a further schematic and partial sectional view of the arrangement shown in FIG. 7 wherein the tensioning strap has been pulled to a tensioned state in the backpack and compressible items have been compressed.

FIGS. 6-8 illustrate an optional embodiment of a tensioning strap assembly 260 used for cinching the backpack 30 towards an inner bottom surface of the first body portion 112 and optionally compressing one or more compressible items 258 within the first body portion 112.

For example, as shown in FIG. 6, a compressible item 258 is disposed in the first body portion 112, and is resting upon an inner surface thereof. The compressible item 258 has an initial height with a dimension $C_1$. The compressible item 258 can be any one or number of items typically packed into luggage. For example, the compressible item 258 can be a collection of clothes or other items that can be compressed into luggage.

Carry bag 230 is positioned on top of the item 258. The carry bag 230 is illustrated with an initial height dimension $B_1$. Although only one end of the first body portion 112, item 258, and carry bag 230 are illustrated, it is to be understood that the same type of configuration can be provided at other ends and sides of these components.

As shown in FIG. 6, a downwardly facing surface of the anchor is at a height of $F_1$ above the inner surface 117. Thus, the height $F_1$ can be considered as the effective height of the anchor 118. Similarly, the effective height of the optional anchor 120 is identified as height $F_2$. The overall depth of the interior volume 116 is identified as depth D. An aspect of at least one of the inventions disclosed herein includes the realization that by locating anchors, such as anchors 118 or 120, at effective heights $F_1$ or $F_2$ which are less than the full height $B_1$ of the carry bag 230, the anchors can be used to compress the carry bag 230, even if there are no compressible objects 258 in the interior volume 116 and the carry bag 230 is resting on the inner surface 117. In this scenario, the carry bag 130 could include compressible items within the main compartment of the carry bag 230, and the anchors 118, 120 can be used for compressing the carry bag 230 and items therein.

With continued reference to FIG. 6, the carry bag 230 includes the connection point 242 on or adjacent to an upper surface of the backpack 30 (in the orientation illustrated in FIGS. 6-8). In this configuration, the connection point 242 is disposed on or at the inwardly facing surface 252 of the carry bag 230. In this optional configuration, the location of the connection point 242 is at an effective height $B_1$ from the surface 250. As noted above, in some embodiments, the height $B_1$ can be greater than the effective heights $F_1$ or $F_2$.

The optional tensioning strap assembly 260 can include any type of tensioning strap arrangement. In the illustrated embodiment, the tensioning strap assembly 260 includes a webbing 261 which can be formed from any type of strap or webbing material, such as those types of straps commonly used in the art for compression purposes. Optionally, the tensioning strap assembly 260 includes a clip 262 connected to one end of the webbing 261. Optionally, the clip 262 includes a hooked portion 264 that is configured to engage the attachment point 242. For example, in some embodiments, the hooked portion 264 can include an open slot and optionally a hook shapes part configured to hook into the loop formed by the connection point 242.

Optionally, the tensioning strap assembly 260 can include additional fastener components for maintaining tension. For example, a portion of the webbing 261 can include one part of a hook and loop fastener 266 and another portion of the webbing 261 can include the other portion of a hook and loop fastener 268. Similarly, the portion at location 268 can also be provided on the connection point 242 at location 270. In some embodiments, the tensioning strap assembly 260 is permanently affixed to the outer luggage body 110. For example, the tensioning strap assembly 260 can be permanently attached to the anchor 118 or anchor 120. In other embodiments, the tensioning strap assembly 260 can be detectably connected to the outer luggage body 110, for example, detachable he connected to either of the anchors 118, 120.

In the illustrated embodiment, the anchor point 118 includes a loop with one end secured at an inner surface of the first body portion 112. The webbing 261 is looped through the anchor point 118 such that the webbing can be pulled through the anchor point 118 in either direction. Other types of devices and structures can also be used as the anchor point 118.

With reference to FIG. 7, in use, the hooked portion of the clip 264 can be engaged with the loop formed by the attachment point 242. With the orientation illustrated in FIG. 7, a user can apply tension to the webbing 261, for example, by pulling upwardly as viewed in FIG. 7. This would have the effect of pulling the webbing 261 through the loop formed by the anchor point 118 and cinching the anchor point 242 towards the bottom surface of the first body portion 112, as illustrated in FIG. 8.

With reference to FIG. 8, the carry bag 230 has been compressed to a compressed height of dimension $B_2$ and the compressible item 258 has been compressed to a height dimension of $C_2$.

In order to maintain the carry bag 230 and compressible item 258 in the illustrated orientation, the webbing 261 can be pulled and pressed over the clip 262 and connection portion 242. As noted above, optionally, the webbing 261 can include hook and loop fasteners. Thus, in the orientation illustrated in FIG. 8, the webbing 261 has been pulled over the clip 262 and connection portion 242 so as to contact the hook and loop portion 266 with the other hook and loop portions 268, 270, to thereby releasably maintain the webbing 261 in the illustrated orientation of FIG. 8, with the carry bag 230 and compressible item 258 in the compressed state. As such, the carry bag 230 functions as both a wearable bag and a compression plate.

Figure 9:
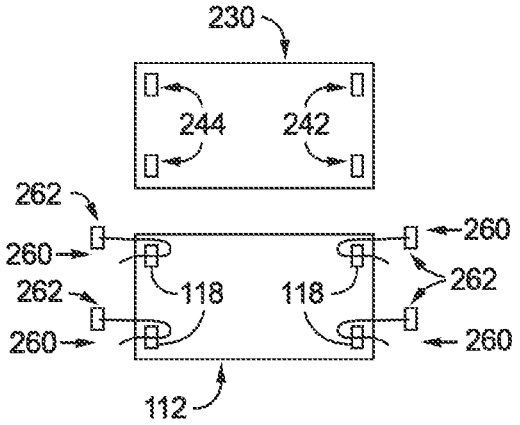
FIG. 9 is a schematic top plan view of the embodiment illustrated in FIG. 6.

FIG. 9 the schematically illustrates the configuration illustrated in FIGS. 3-5. More specifically, FIG. 9 includes four tensioning strap assemblies 260, each one engaged with one of the four anchors 118, as described above with reference to FIGS. 3-5. In the configuration of FIG. 9, the luggage system can be considered as including a first pair of upper compression strap assemblies 260 (on the left side of FIG. 9) and a second pair of lower compression strap assemblies 260 (on the right side of FIG. 9).

Figure 10:
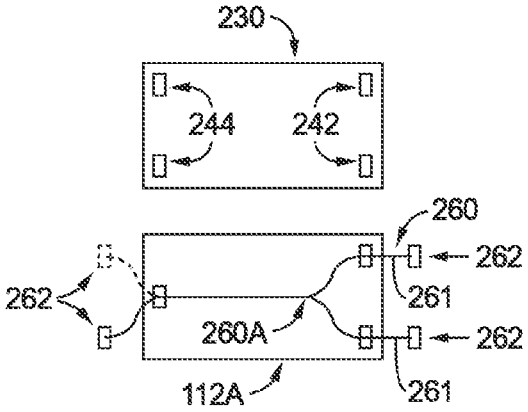
FIG. 10 is a schematic top plan view of a modification of the embodiment illustrated in FIG. 9.

FIG. 10 illustrates a modification of the embodiment of FIG. 9. As shown in FIG. 10, the modified luggage body portion 112A includes one anchor 118 at the upper end, and two anchors 118 at the lower end, and a single integrated tensioning strap assembly 260A. The integrated tensioning strap assembly 260A includes a bifurcated end (the right end as viewed in FIG. 10), which includes two portions of webbing 261 and a central merged or non-bifurcated portion that extends to the single anchor 118 on the upper end. In some embodiments, the upper end of the tensioning strap assembly 260A can include a single portion of webbing 261 and a single connector 262. Optionally, the tensioning strap assembly 260A can include another bifurcation forming a second portion of webbing 261 and a second connector 262 (illustrated in phantom line).

Figure 11:
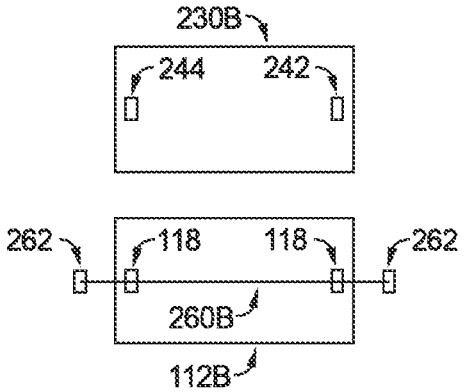
FIG. 11 is a schematic top plan view of another modification of the embodiment illustrated in FIG. 9.

FIG. 11 illustrates another modification of the embodiment of FIG. 9. As shown in FIG. 11, the modified carry bag 230B includes only a single upper end connector 244 and a single lower end connector 242. Further, the modified luggage body portion 112B includes only one anchor 118 at the upper end (the left side as viewed in FIG. 11) of the luggage body portion 112B and a single anchor 118 at the lower end (the right side as viewed in FIG. 11) of the luggage body portion 112B. Additionally, the modified tensioning strap assembly 260B includes only a single portion of webbing 261 extending between the clips 262.

In some embodiments, the clips 262 can be eliminated and free ends of the webbing 261 can be engaged with connectors 242, 244 by way of being passed through loops formed by the connectors 242, 244 and/or with additional clips or connectors (not illustrated). Additionally, other configurations of the tensioning strap assemblies 260, 260A, 260B can also be used.

While several embodiments are presented in the foregoing detailed description, a vast number of variations exist. The embodiments described herein are not intended to limit the scope, applicability, or configuration of the claimed subject matter in any way. Rather, the foregoing detailed description provides those skilled in the art with a convenient road map for implementing the described embodiments. Various changes can be made in the function and arrangement of elements without departing from the scope defined by the claims, which includes known equivalents and foreseeable equivalents at the time of filing this patent application.

What is claimed is:

1. A luggage system comprising:

an outer luggage body comprising:

a first luggage body portion including a first upper periphery, a first sidewall extending around the first upper periphery and a first inner wall recessed inwardly from the first upper periphery and connected to the first sidewall, wherein a first interior volume portion is defined between the first inner wall, the first upper periphery, and the first sidewall;

a second luggage body portion defining a second interior volume portion and including a second upper periphery, the second luggage body portion being connected to the first luggage body portion so as to be moveable between opened and closed positions;

a closure mechanism configured to releasably secure the first and second luggage body portions in the closed position; and at least first and second upper anchors and first and second lower anchors secured to the first luggage body portion at locations spaced from the second upper periphery and recessed within the second interior volume portion; and a carry bag in a form of a backpack, comprising:

a main body portion including an upper portion, a lower portion, and at least one interior compartment;

first and second upper shoulder strap connectors secured to the upper portion of the main body portion;

first and second lower shoulder strap connectors secured to the lower portion of the main body portion;

a first shoulder strap including first upper and first lower connectors configured to releasably engage the first upper shoulder strap connector and the first lower shoulder strap connector, respectively;

a second shoulder strap including second upper and second lower connectors configured to releasably engage the second upper shoulder strap connector and the second lower shoulder strap connector, respectively; and a first pair of upper compression straps, each of the first pair of upper compression straps including a first free end and a first compression strap connector configured to releasably engage one of the first and second upper connectors, each of the pair of first compression straps being engaged with one of the first and second upper anchors such that when each first compression strap connector is engaged with each first upper connector, each first free end of each first compression strap can be pulled so as to cinch the upper portion of the main body portion towards the first and second upper anchors for compressing objects positioned between the main body portion and an inner surface of the first luggage body portion; and a second pair of lower compression straps, each of the second pair of lower compression straps including a second free end and a second compression strap connector configured to releasably engage one of the first and second lower connectors, each of the second pair of lower compression straps being engaged with one of the first and second lower anchors such that when each second compression strap connector is engaged with each lower connector, each second free end of each second lower compression strap can be pulled so as to cinch the lower portion of the main body portion towards the first and second lower anchors for compressing objects positioned between the main body portion and the inner surface of the first luggage body portion;

wherein the carry bag functions as a wearable backpack when the first and second shoulder straps are connected to the main body portion and functions as a compression plate when the main body portion is cinched towards the inner surface of the first luggage body portion with the first pair of upper compression straps and the second pair of lower compression straps.

2. The luggage system of claim 1, wherein the main body portion of the carry bag includes a user-facing side and wherein the carry bag and the first and second shoulder straps are configured such that the user-facing side rests against a user of the carry bag, in use, and wherein the first and second lower shoulder strap connectors are fixed to the user-facing side of the main body portion.

3. The luggage system of claim 1, wherein the main body portion of the carry bag includes an outwardly-facing side and wherein the carry bag and the first and second shoulder straps are configured such that the outwardly-facing side faces away from a user of the carry bag, in use, and wherein the first and second lower shoulder strap connectors are fixed to the outwardly-facing side of the main body portion.

4. A luggage system comprising:

an outer luggage body comprising:

a first luggage body portion including a first upper periphery, a first sidewall extending around the first upper periphery and a first inner wall recessed inwardly from the first upper periphery and connected to the first sidewall, wherein a first interior volume portion is defined between the first inner wall, the first upper periphery, and the first sidewall;

a second luggage body portion defining a second interior volume portion and including a second upper periphery, the second luggage body portion being connected to the first luggage body portion so as to be moveable between opened and closed positions;

a closure mechanism configured to releasably secure the first and second luggage body portions in the closed position; and at least first and second upper anchors and first and second lower anchors secured to the first luggage body portion at locations spaced from the second upper periphery and recessed within the second interior volume portion;

a carry bag in a form of a backpack, comprising:

a main body portion including an upper portion, a lower portion, and at least one interior compartment;

first and second upper shoulder strap connectors secured to the upper portion of the main body portion;

first and second lower shoulder strap connectors secured to the lower portion of the main body portion;

a first shoulder strap including first upper and first lower connectors configured to releasably engage the first upper shoulder strap connector and the first lower shoulder strap connector, respectively; and a second shoulder strap including second upper and second lower connectors configured to releasably engage the second upper shoulder strap connector and the second lower shoulder strap connector, respectively;

a first upper compression strap including a first free end and a first compression strap connector configured to releasably engage the first upper connector, the first upper compression strap being engaged with the first upper anchor such that when the first compression strap connector is engaged with the first upper connector, the first free end of the first upper compression strap can be pulled so as to cinch the upper portion of the main body portion towards the first upper anchor; and a second lower compression strap including a second free end and a second compression strap connector configured to releasably engage the first lower connectors, the second lower compression strap being engaged with the first lower anchor such that when the second compression strap connector is engaged with the first lower connector, the second free end can be pulled so as to cinch the lower portion of the main body portion towards the first lower anchors.

5. The luggage system of claim 4, wherein the first upper and lower compression straps are configured to compress objects positioned between the main body portion and an inner surface of the first luggage body portion.

6. The luggage system of claim 4, additionally comprising a second upper compression strap configured to engage the second upper second upper connector and the second upper anchors and a second lower compression strap.

7. The luggage system of claim 4, wherein the carry bag functions as a backpack when the first and second shoulder straps are connected to the main body portion and as a compression plate when the main body portion is engaged with the first luggage body portion with the first upper compression strap and the second lower compression strap.

8. The luggage system of claim 4, wherein the main body portion of the carry bag includes a user-facing side and wherein the carry bag and the first and second shoulder straps are configured such that the user-facing side rests against a user of the carry bag, in use, and wherein the first and second lower shoulder strap connectors are fixed to the user-facing side of the main body portion.

9. The luggage system of claim 4, wherein the main body portion of the carry bag includes an outwardly-facing side and wherein the carry bag and the first and second shoulder straps are configured such that the outwardly-facing side faces away from a user of the carry bag, in use, and wherein the first and second lower shoulder strap connectors are fixed to the outwardly-facing side of the main body portion.

* * * * *